US007765828B2

(12) United States Patent
Wu et al.

(10) Patent No.: US 7,765,828 B2
(45) Date of Patent: Aug. 3, 2010

(54) METHOD AND APPARATUS FOR FORMING ASYMMETRICAL ICE CUBES

(75) Inventors: Guolian Wu, Saint Joseph, MI (US); Kevin Michael Chase, Saint Joseph, MI (US); Marcus Roland Fischer, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 172 days.

(21) Appl. No.: 11/924,023

(22) Filed: Oct. 25, 2007

(65) Prior Publication Data

US 2008/0155998 A1 Jul. 3, 2008

Related U.S. Application Data

(60) Provisional application No. 60/877,657, filed on Dec. 29, 2006.

(51) Int. Cl.
*F25C 1/24* (2006.01)

(52) U.S. Cl. ..... 62/353; 62/351; 62/1

(58) Field of Classification Search ..... 62/351, 62/353

See application file for complete search history.

(56) References Cited

U.S. PATENT DOCUMENTS

| | | | | |
|---|---|---|---|---|
| 3,390,543 | A | 7/1968 | Moreland, II et al. | |
| D244,275 | S | 5/1977 | Gurbin | |
| 4,023,768 | A | 5/1977 | Herrera-Casasus | |
| D318,281 | S | 7/1991 | McKinlay | |
| 5,056,322 | A * | 10/1991 | Patrick | 62/73 |
| 2006/0207282 | A1 * | 9/2006 | Visin et al. | 62/351 |
| 2006/0242971 | A1 | 11/2006 | Cole et al. | |

* cited by examiner

*Primary Examiner*—Cheryl J Tyler
*Assistant Examiner*—Lakiya Rogers
(74) *Attorney, Agent, or Firm*—Kirk W. Goodwin; Diederiks & Whitelaw PLC

(57) ABSTRACT

A refrigerator includes a freezer compartment provided with an automatic icemaker incorporating a mold configured to produce truncated, crescent-shaped ice cubes. With this arrangement, the icemaker produces cubes that are shorter than full, standard crescent-shaped cubes. The reduced mold size advantageously enables the icemaker to take less space in a freezer compartment, without a significant reduction in ice cube volume.

10 Claims, 3 Drawing Sheets

METHOD AND APPARATUS FOR FORMING ASYMMETRICAL ICE CUBES

CROSS-REFERENCE TO RELATED APPLICATION

The present application claims the benefit of U.S. Provisional Patent Application Ser. No. 60/877,657 filed Dec. 29, 2006 entitled "Method and Apparatus for Forming Asymmetrical Ice Cubes."

BACKGROUND OF THE INVENTION

1. Field of the Invention

The present invention pertains to the art of refrigerators and, more particularly, to a refrigerator door mounted icemaker that produces asymmetrical ice cubes.

2. Description of the Related Art

Incorporating an automatic icemaker into a refrigerator is well known in the art. In most cases, the icemaker is mounted in a freezer compartment portion of the refrigerator. The icemaker is supplied with water and produces ice, in a mold, as required by a user. Most icemakers are provided with a sensor, e.g., a bail arm or the like, that detects an amount of ice in an ice cube storage bin. When the amount of ice falls below a predetermined level, the icemaker is filled with water and an ice production cycle is initiated. At the end of the ice production cycle, a motor shifts a plurality of lifting fingers to release recently formed ice cubes into the ice cube storage bin. In some cases, the icemaker includes a heater that is selectively activated to aid in releasing the ice cubes.

In addition to dispensing ice into an ice storage bin, many refrigerators are provided with a door mounted dispenser that enables a user to retrieve ice, and often times water, without having to access a refrigerated compartment. Typically, a chute extends between the icemaker and the dispenser to guide ice cubes from the ice cube storage bin to the user. In some cases, the icemaker includes an ice crusher that delivers crushed ice on demand. However, as the door must move between open and closed positions, the chute must register with the icemaker each time the door is closed. In addition, a position or interlock switch is required to ensure that the chute is properly positioned before enabling the dispenser to deliver ice to the user.

In the highly competitive field of home appliances, eliminating parts and material, even small parts and small amounts of material, can result in a significant cost savings. Thus, several manufactures have turned to mounting the icemaker to the freezer door. This arrangement not only simplifies the transfer if ice cubes from the ice cube storage bin to the dispenser, but also eliminates any need for interlock switches. Unfortunately, most existing icemakers have a wide footprint which, when mounted to a door, not only requires that the ice cube storage bin be of a certain size, but also requires modifications to shelving in the freezer compartment. The modifications to the shelving undesirably reduce storage space in the refrigerator.

Based on the above, there exists a need for a door mounted icemaker having a narrow footprint so as to be accommodated on a freezer compartment door without significantly reducing, and preferably without even modifying, existing freezer storage capacity. Moreover, there exists a need for an icemaker having a narrow footprint that will produce ice cubes having a volume substantially corresponding to current configurations.

SUMMARY OF THE INVENTION

The present invention is directed to a refrigerator including a cabinet having at least one refrigerated compartment. The refrigerator includes a refrigeration system for lowering a temperature of the at least one refrigerated compartment to below freezing temperatures and a door mounted for movement relative to the cabinet for selectively providing access to the at least one refrigerated compartment. The refrigerator includes an automatic icemaker in the refrigerated compartment, with the icemaker being preferably supported on the door. In accordance with the invention, the icemaker includes an ice mold configured to produce truncated, crescent-shaped ice cubes. With this arrangement, the icemaker presents a much narrower footprint and produces smaller ice cubes. However, the particular shape of the ice cubes provides for a volume that is only marginally less than full, crescent-shaped cubes.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF PREFERRED EMBODIMENTS

Figure 1:
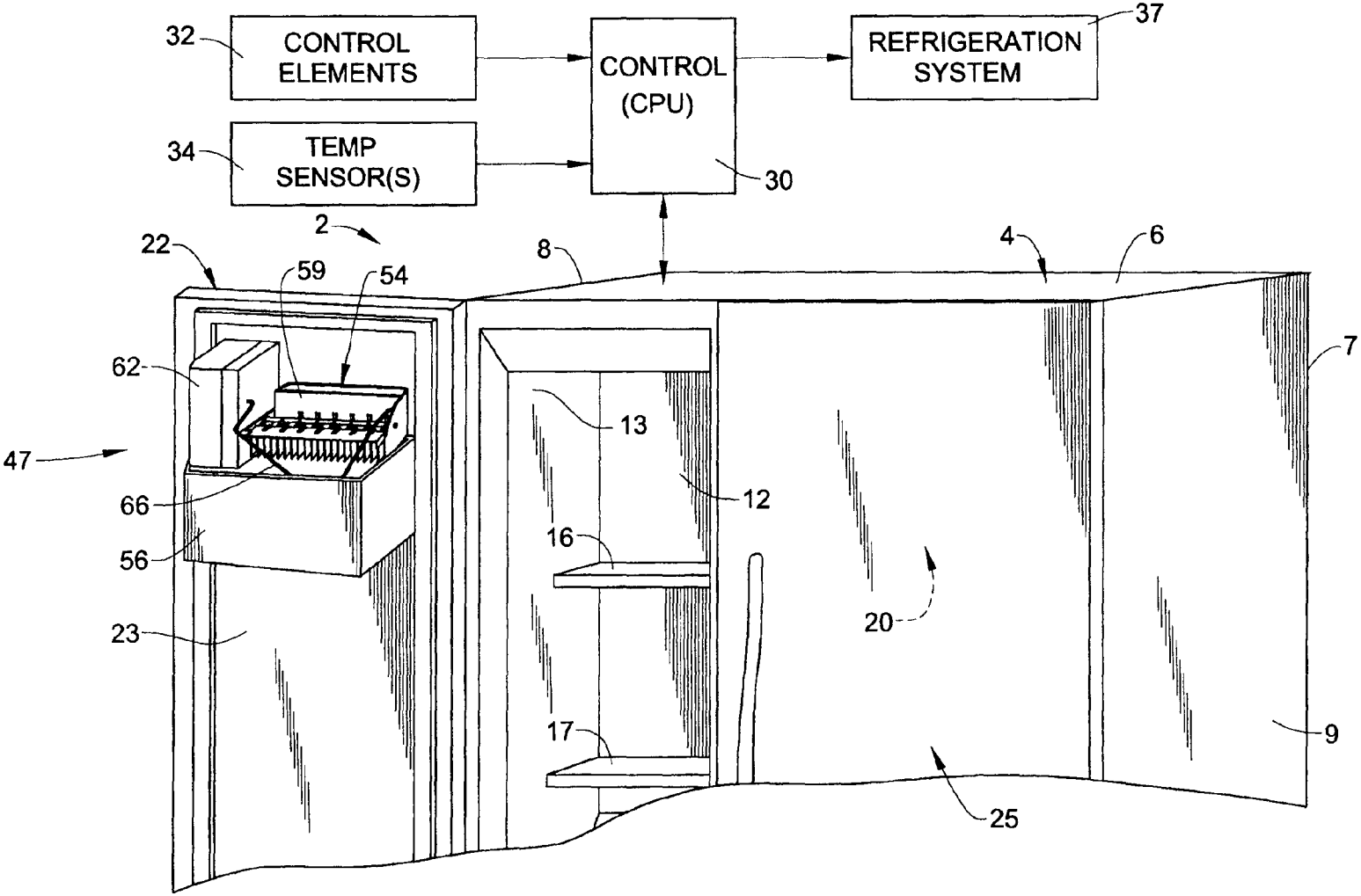
FIG. 1 is a partial, perspective view of a side-by-side refrigerator incorporating an icemaker that produces asymmetrical ice cubes having truncated, crescent-shapes in accordance with the present invention.

With initial reference to FIG. 1, a refrigerator, generally indicated at 2, includes a cabinet 4 having a top wall 6, a rear wall 7 and opposing sidewalls 8 and 9. In the embodiment shown, refrigerator 2 includes a freezer compartment 12 having an inner liner 13 and a plurality of shelves, two of which are indicated at 16 and 17. Arranged alongside freezer compartment 12 is a fresh food compartment 20 having a corresponding liner and shelves (not shown). A freezer door 22, having an inner liner 23, is pivotally mounted for movement relative to cabinet 4 for selectively closing freezer compartment 12. Similarly, a fresh food compartment door 25 is also pivotally mounted for movement relative to cabinet 4 for selectively closing fresh food compartment 20. At this point, it should be recognized that the above arrangement describes a conventional side-by-side refrigerator. However, as will become more readily apparent below, the present invention can be incorporated into a variety of refrigerator models, including top mount, bottom mount and French door-style refrigerators, as well as stand alone ice cube making units. In any case, refrigerator 2 is shown to include a control 30 that, based upon inputs received from a plurality of control elements 32 and temperature sensors 34, regulates a refrigeration system 37 to maintain selected temperatures within freezer compartment 12 and fresh food compartment 20 in a manner known in the art.

In accordance with the invention, refrigerator 2 includes an icemaker assembly 47 including an automatic icemaker 54 and an ice cube storage bin 56. In the most preferred embodiment of the invention, icemaker 54 is mounted to liner 23 of freezer door 22. Icemaker 54 includes an ice mold 59 which, as will be discussed more fully below, is configured to produce truncated, crescent-shaped ice cubes. Icemaker 54 also includes a motor 62 that selectively rotates a plurality of rake or lifting fingers (not shown) that guide ice cubes from ice mold 59 to ice cube storage bin 56 at the completion of an ice production cycle. In addition, icemaker 54 includes a level sensor, shown in the form of a bail arm 66, that selectively activates an ice production cycle in the event that a level of ice in ice cube storage bin 56 falls below a predetermined level. Of course, it should be understood that a variety of different ice level sensors could be employed in connection with the present invention.

Figure 2:
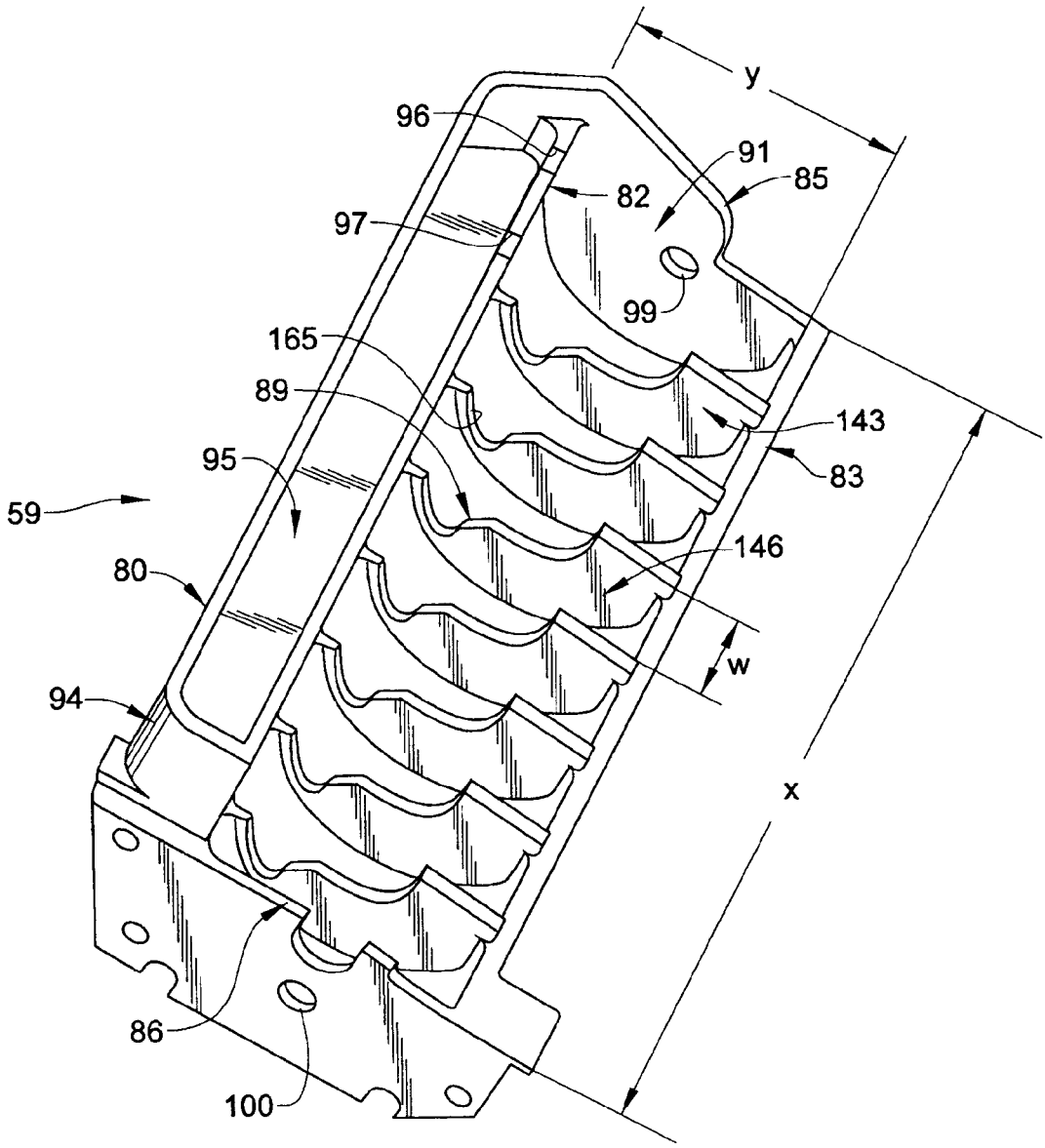
FIG. 2 is an upper right perspective view of an ice mold portion of the icemaker of FIG. 1.

As best shown in FIG. 2, ice mold 59 includes a mold body 80 having first and second laterally opposing side portions 82 and 83 that are interconnected by first and second longitudinally opposing end portions 85 and 86, as well as a bottom wall 89, that collectively define a mold cavity 91. Mold body 80 also includes a water inlet portion 94 having a trough 95 provided with a pair of openings 96 and 97 which lead into mold cavity 91. With this arrangement, at the start of an ice production cycle, water enters inlet portion 94 and flows into trough 95. From trough 95, the water passes through openings 96 and 97 before settling in mold cavity 91. At this point, the water freezes to form ice cubes as will be discussed more fully below. Furthermore, mold body 80 is provided with a pair of longitudinally opposing apertures 99 and 100 that define a rotation axis for a rake finger assembly (not shown). At the completion of the ice production cycle, the ice cubes are ejected into ice cube storage bin 56 through rotation of the rake finger assembly. In some cases, a heater (not shown) is activated to facilitate the transfer of ice from ice mold 59.

As indicated, mold body 80 has a length "x" which, in a preferred embodiment, is approximately 22 cm, and a width "y" that is approximately 68 mm. In any case, icemaker 54 is sized so as to be readily mounted to liner 23 of freezer door 22 without requiring any internal modifications to shelves 16 and 17 or liner 13 of freezer compartment 12. In accordance with the invention, in order to minimize volume loss of ice cubes formed in ice mold 59, bottom wall 89 of mold cavity 91 is formed in a truncated, crescent-shape as will be discussed more fully below.

Figure 3:
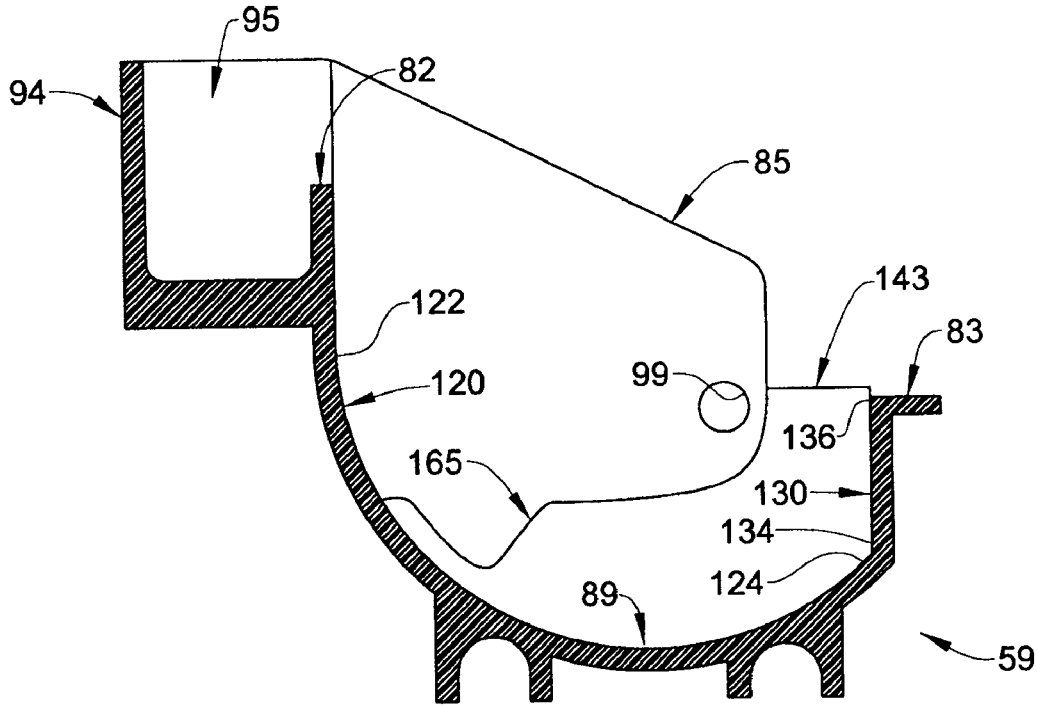
FIG. 3 is a cross-sectional side view of the ice mold of FIG. 2.

As best shown in FIG. 3, bottom wall 89 includes a first inner surface portion 120 defined by a first, upper end portion 122 that gradually slopes down and away, as shown in the orientation of FIG. 3, from side portion 82. First, upper end portion 122 leads to a second end portion 124 that is spaced from and positioned below, side portion 83. A second inner surface portion 130 of bottom wall 89 includes a first end section 134 that extends from second end portion 124 substantially, vertically upward to a second end section 136 which terminates at side portion 83. Therefore, first inner surface portion 120 slopes gradually in a concave manner. Rather than continuing along a smooth, concave path, second inner surface portion 130 is abruptly re-directed, i.e., extends sharply upwardly as shown in this figure.

Mold body 80 is shown to include a plurality of dividers, one of which is indicated at 143, that separate mold cavity 91 into a plurality of truncated, crescent-shaped mold sub-cavities 146, each having a width "w" which, in the most preferred embodiment, is preferably approximately 20 mm. Each divider 143 is provided with a notch 165 that allows water to flow between successive mold sub-cavities 146 so as to be evenly distributed in mold cavity 91 in order to form a corresponding plurality of truncated, crescent-shaped ice cubes, one of which is shown at 160 in FIG. 4.

In further accordance with the invention, each truncated, crescent-shaped ice cube 160 includes a first, substantially planar surface 184 having first and second opposing edge zones 187 and 188. A second, convex surface 191, having a first end 193, gradually slopes away from first edge zone 187 towards a terminal edge 194. In the position shown in FIG. 4, terminal edge 194 is spaced approximately directly below second edge zone 188. A third surface 197 has a first end section 199 that extends abruptly from terminal edge 194 of second surface 191 directly to a second end section 200 that terminates at second edge zone 188. With this arrangement, third surface 197 is substantially perpendicular to first surface 184. Truncated, crescent-shaped ice cube 160 further includes a pair of laterally opposing side surfaces, one of which is shown at 203.

In the most preferred form of the invention, truncated, crescent-shaped ice cube 160 includes a length "L" which is preferably about 50 mm. More specifically, if a standard crescent-shaped ice cube includes a length L', which is generally in the order of 60 mm, truncated, crescent-shaped ice cube 160 is 16.5% smaller in overall length. In accordance with the invention, a reduction in the order of 15-20% is most preferable. Obviously, this reduction in the length of ice cube 160 provides for a corresponding reduction in the size of mold body 80. At this point, it should be readily apparent that, while preferably maintaining a standard width "w", each truncated, crescent-shaped ice cube 160 is shorter than a full, standard crescent-shaped ice cube, thereby allowing icemaker 54 to exhibit a narrow footprint in order to advantageously reside on freezer door 22. Moreover, the present invention not only allows for the construction of a narrow icemaker, but also the formation of ice cubes which are considered to be advantageously shaped so as to minimize volume loss "v", thereby enabling a desired number of ice production cycles to be maintained. That is, reducing the size of the ice cubes inherently results in a corresponding requirement for more frequent ice production cycles in order to meet demands. However, forming ice cubes 60 in accordance with the present invention provides an extremely effective and significant reduction in overall icemaker size, with only a minimum reduction in the overall volume of the ice cubes themselves, thereby assuring that the number of additional ice production cycles is minimized.

Figure 4:
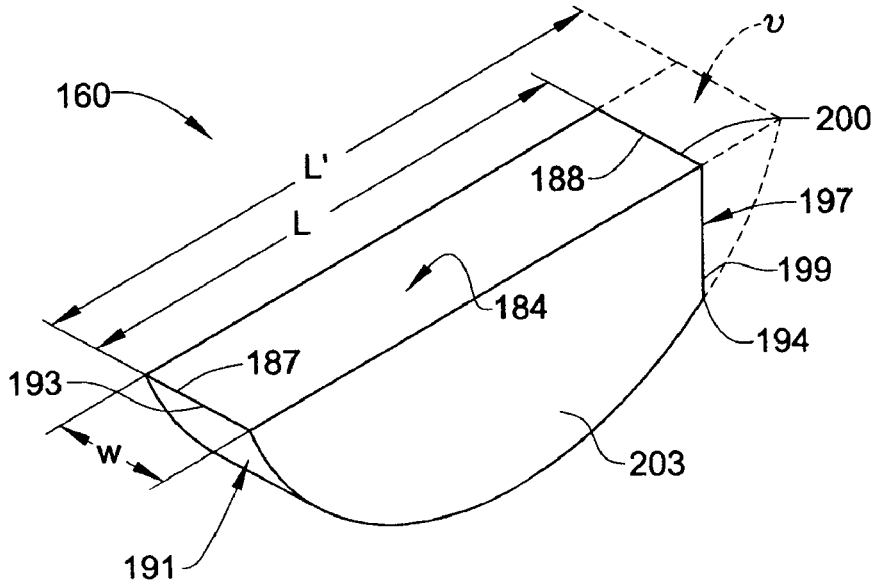
FIG. 4 is an upper right perspective view of an asymmetrical ice cube, having a truncated, crescent-shape, formed in the icemaker of FIG. 1.

It should further be apparent that, by truncating ice cubes 160, it is meant that each ice cube 160 represents a shortened version of a standard crescent-shaped ice cube having two substantially planar side surfaces arranged at a perpendicular angle to a flat side portion and connected by a arcuate or convex opposing side portion such as shown in FIG. 4. As set forth above, the present invention allows for an icemaker to be readily mounted to a freezer door of a refrigerated appliance without requiring internal modifications to a freezer compartment to accommodate a standard size icemaker while, at the same time, producing ice cubes having a volume substantially corresponding to standard crescent-shaped ice cubes. This particular arrangement advantageously assures to minimize an overall number of ice production cycles relative to other forms of smaller ice cubes.

Although described with reference to a preferred embodiment of the invention, it should be readily understood that various changes and/or modifications can be made to the invention without departing from the spirit thereof. For instance, the icemaker could be part of a dispensing system provided on the freezer door. In addition, the icemaker could be provided with a crushing mechanism to selectively deliver crushed ice to a user. In general, the invention is only intended to be limited by the scope of the following claims.

What is claimed is:

1. A refrigerated appliance comprising:

a cabinet including at least one refrigerated compartment;

a refrigeration system in communication with the at least one refrigerated compartment for lowering the at least one refrigerated compartment to below freezing temperatures;

a door mounted for movement relative to the cabinet for providing selective access to the at least one refrigerated compartment; and an automatic icemaker including an ice mold producing truncated, crescent-shaped ice cubes in the at least one refrigerated compartment, wherein the ice mold includes at least one mold cavity defined, at least in part, by a bottom wall having: a first inner surface portion having a first end portion that slopes gradually, in a concave manner, to a second end portion; and a second inner surface portion which is abruptly re-directed upwardly from the second end portion to a level of the first end portion forming a truncated, crescent-shaped cavity; and wherein the mold has a more narrow ice making footprint than a crescent-shaped mold.

2. The refrigerated appliance according to claim 1, wherein the ice mold includes a plurality of divider walls each including a notch formed therein, wherein the plurality of divider walls extend, at spaced locations, between the first and second inner surface portions forming a plurality of truncated, crescent-shaped sub-cavities.

3. The refrigerated appliance according to claim 1, wherein the door is pivotally mounted to the cabinet, said icemaker being mounted to the door.

4. A refrigerated appliance comprising:

a cabinet including at least one refrigerated compartment;

a refrigeration system in communication with the at least one refrigerated compartment for lowering the at least one refrigerated compartment to below freezing temperatures;

a door mounted for movement relative to the cabinet for providing selective access to the at least one refrigerated compartment; and means for producing truncated, crescent-shaped ice cubes in the at least one refrigerated compartment, said means including at least one mold cavity defined, at least in part, by a bottom wall having: a first inner surface portion having a first end portion that slopes gradually, in a concave manner, to a second end portion; and a second inner surface portion which is abruptly re-directed upwardly from the second end portion to a level of the first end portion forming a truncated, crescent-shaped cavity.

5. The refrigerated appliance according to claim 4, wherein said means for producing truncated, crescent-shaped ice cubes further includes a plurality of divider walls each including a notch formed therein, wherein the plurality of divider walls extend, at spaced locations, between the first and second inner surface portions forming a plurality of truncated, crescent-shaped sub-cavities.

6. The refrigerated appliance according to claim 4, wherein the door is pivotally mounted to the cabinet, said icemaker being mounted to the door.

7. An automatic icemaker for a refrigerator comprising: an ice mold configured to produce truncated, crescent-shaped ice cubes, wherein the ice mold includes at least one mold cavity defined, at least in part, by a bottom wall having: a first inner surface portion having a first end portion that slopes gradually, in a concave manner, to a second end portion; and a second inner surface portion which is abruptly re-directed upwardly from the second end portion to a level of the first end portion forming a truncated, crescent-shaped cavity; and wherein the crescent-shaped ice cubes have a length which is approximately 15-20% less than a length of a corresponding, non-truncated, crescent-shaped ice cube.

8. A method of forming ice cubes comprising:

supplying water to an ice mold located in a refrigerated compartment, the ice mold including at least one mold cavity defined, at least in part, by a bottom wall having: a first inner surface portion having a first end portion that slopes gradually, in a concave manner, to a second end portion; and a second inner surface portion which is abruptly re-directed upwardly from the second end portion to a level of the first end portion forming a truncated, crescent-shaped cavity;

directing the water to fill the at least one mold cavity;

freezing the water; and ejecting truncated, crescent-shaped ice cubes from the mold.

9. The method of claim 8, wherein each truncated, crescent-shaped ice cubes has an associated length which is approximately 15-20% less than a length of a corresponding, non-truncated, crescent-shaped ice cube.

10. The refrigerated appliance according to claim 1, wherein the truncated, crescent-shaped ice cubes have a length which is approximately 15-20% less than a length of a corresponding, non-truncated, crescent-shaped ice cube.

* * * * *